US006244533B1

(12) United States Patent
Badiali et al.

(10) Patent No.: US 6,244,533 B1
(45) **Date of Patent: *Jun. 12, 2001**

(54) DEVICE FOR LOADING SPOOLS ONTO A SUPPORT PLATE, FOR TRANSPORT AND POSITIONING OF THE SPOOLS IN TEXTILE MACHINES

(75) Inventors: Roberto Badiali, Pordenone; Luigi Piva, Fiume Veneto; Amedeo Quaia, Porcia; Maurizio Raffin, Cordenons, all of (IT)

(73) Assignee: Savio Macchine Tessili S.p.A., Pordenone (IT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/359,658

(22) Filed: Jul. 26, 1999

(30) Foreign Application Priority Data

Aug. 3, 1998 (IT) ..... MI98A1819

(51) Int. Cl.[7] ..... B65H 54/22; D01H 13/26; B65G 37/00

(52) U.S. Cl. ..... 242/474.1; 57/281; 198/487.1

(58) Field of Search ..... 242/474, 474.1, 242/474.2, 470; 57/281; 414/609, 222.05, 910; 198/400, 479.1, 468.8, 487.1, 803.12

(56) References Cited

U.S. PATENT DOCUMENTS

| | | | | |
|---|---|---|---|---|
| 3,712,449 | * | 1/1973 | Holovnia et al. | 198/487.1 X |
| 3,951,350 | * | 4/1976 | Uchida | 242/474.1 |
| 4,634,066 | * | 1/1987 | Matsui et al. | 242/474.1 |
| 5,205,397 | * | 4/1993 | Sanno | 198/468.8 X |
| 5,588,602 | * | 12/1996 | Uno et al. | 242/474 |
| 5,954,293 | * | 9/1999 | Luigi et al. | 57/281 X |

FOREIGN PATENT DOCUMENTS

| | | |
|---|---|---|
| 34 28 066 | 2/1985 | (DE) . |
| 0 844 206 | 5/1998 | (EP) . |
| 2 554 098 | 5/1985 | (FR) . |

* cited by examiner

*Primary Examiner*—Michael R. Mansen
(74) *Attorney, Agent, or Firm*—Oblon, Spivak, McClelland, Maier & Neustadt, P.C.

(57) ABSTRACT

A spool loading and centering device for loading and centering spools on support plates in order to send the said spools for winding. Each support plate has a rod and centering and restraining springs. The spool loading and centering device includes a spool presentation and centering device for presenting and centering of each spool onto each support plate and a spool fitting device for fitting the tube of each spool onto the top of the rod of each support plate. The spool fitting device travels a path which corresponds to fitting of the spool, as far as its base stop on the support plate.

8 Claims, 11 Drawing Sheets

DEVICE FOR LOADING SPOOLS ONTO A SUPPORT PLATE, FOR TRANSPORT AND POSITIONING OF THE SPOOLS IN TEXTILE MACHINES

BACKGROUND OF THE INVENTION

1. Field of the Invention

The present invention relates to the movement of spools in textile machines for preparation of yarns, and in particular to a device and a method for loading the spools onto an individual, mobile support plates, for transport and positioning of the spools during processing.

2. Discussion of Background

In the known art, substantial preference has been given to moving the spools and tubes in the operations of production, control and packaging of the yarn, starting from textile fiber roving, using support plates, to be placed on conveyor belts or similar movement units used by the machine, in order to convey the spools and tubes individually to and from the work stations, at which spinning and spooling in particular are carried out.

In general, the support plates are provided with a vertical central pin, which makes it possible to keep the spools in an erect position, not only during transport, but also during the steps of preparation and winding, virtually without touching the spools, and with handling only of the support plates, without the support plates needing to touch, and slide into contact with, the machine, and therefore become dirty or damaged.

A problem which is associated with the use of support plates according to the known art, arises during the step of winding the spools in the spooler. In fact, account must be taken of the fact that in spoolers of the most recent design, the winding speeds are very high. This therefore generates stresses, which tend to displace the spool, or even pull the spool off of the pin of the support plate, on which it is simply supported as it is wound.

In order to eliminate these disadvantages, more elaborate support plate structures have been proposed, in which the support plate is provided with resilient means for retention of the spool, as well as with conical raiser fins for centering of the latter, for example in patents DE-A-4,236,038, and U.S. Pat. No. 5,297,761 in the name of Schlafhorst, and in the Italian patent application MI96A125 and European patent application EP-A-844,206, in the name of the same applicant.

These technical solutions consist of fitting the tube of the spool on the support plate, centering the spool, and overcoming specific resistance by the resilient retention means. This problem is significant, particularly if account is taken of the fact that the rate of supply of the spools to the spooler is very fast, particularly during the steps of starting up, or a change of processing. The time allowed for loading a spool onto its support plate, and for starting the processing, is approximately one second or slightly more.

SUMMARY OF THE INVENTION

In order to make more apparent both the technical problems posed and solved by means of the present invention, and its characteristics and advantages relative to the known art, the present invention is described here, purely by way of non-limiting example, with reference to its application for loading spools in a spooler, using a support plate, as described in the aforementioned European patent application EP-A-844,206, in the name of the same applicant.

The present invention thus relates to a device and a method for loading a spool onto the individual support plate. The present invention provides a device for loading and centering spools on support plates. The support plates are provided with a rod and centering and restraining springs. The spools are to be sent for winding of yarn therearound to an automatic spooler. The device for loading and centering of the spools on the support plates includes: a device for presentation and centering of the spool on the top of the rod of the plate support; a device for fitting the spool, the spool fitting device including a slider element, which is provided with means for actuation of vertical travel with reciprocal motion, and is provided with a fitting end element, which can follow a useful path which corresponds to fitting of the tube of the spool, until it is supported against the conical base stop of the support plate.

The present invention also provides a method for loading and centering of spools on support plates, the support plates being provided with a rod and centering and restraining springs, and the spool to be sent for winding of yarn therearound to an automatic spooler. The method for loading and centering of spools on support plates includes the steps of: presenting and centering the spool on the top of the rod of the support plate; releasing the spool presented, until the spool is supported on the springs of the support plate; and fitting the spool with a useful path which extends until the spool is supported against a base stop of the support plate.

BRIEF DESCRIPTION OF THE DRAWING FIGURES

The characteristics and advantages of the device and the method according to the present invention are made more apparent by the description of a typical embodiment, provided by way of non-limiting example, which is illustrated in FIGS. 1 to 10.

Figure 9:
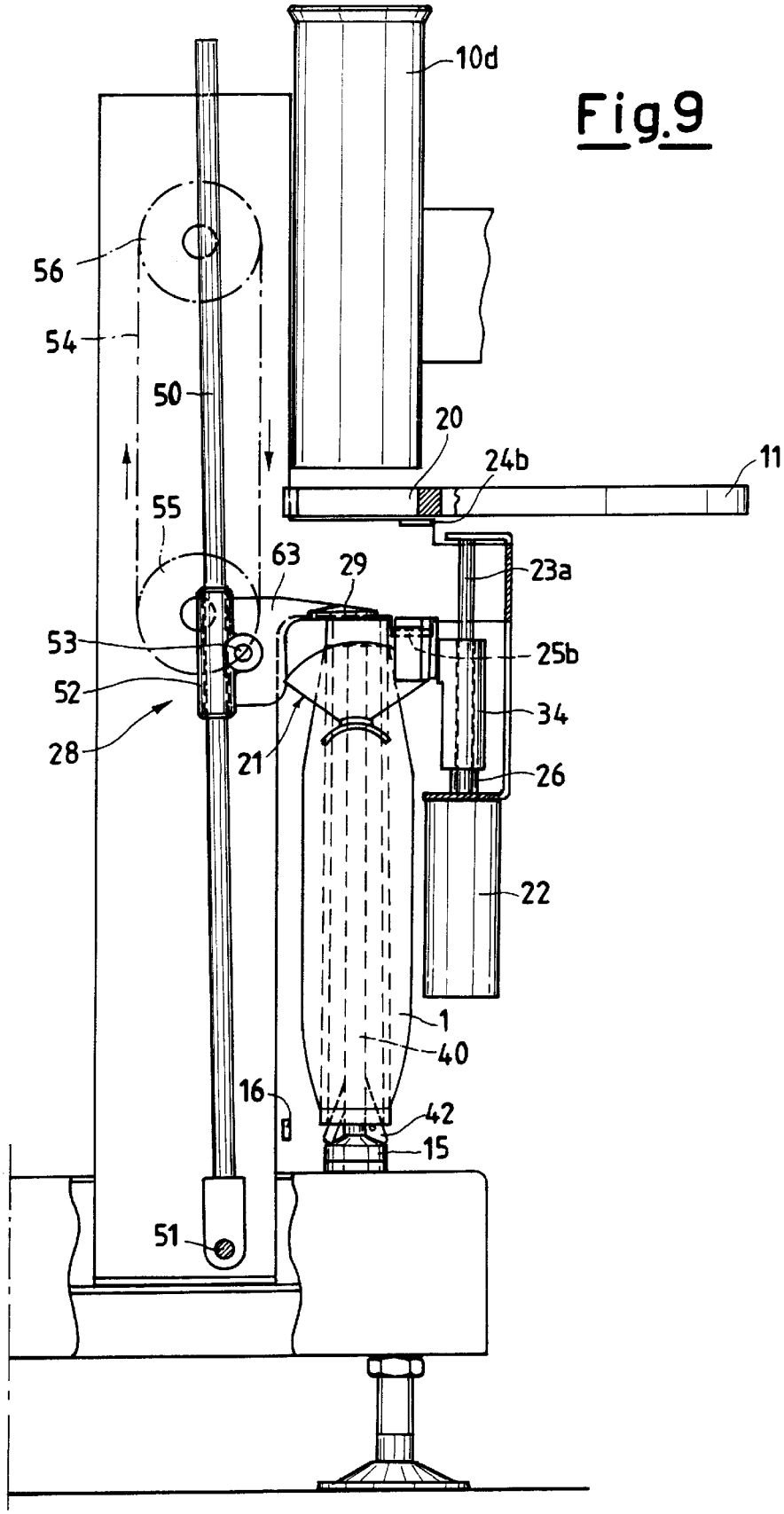
Figure 10:
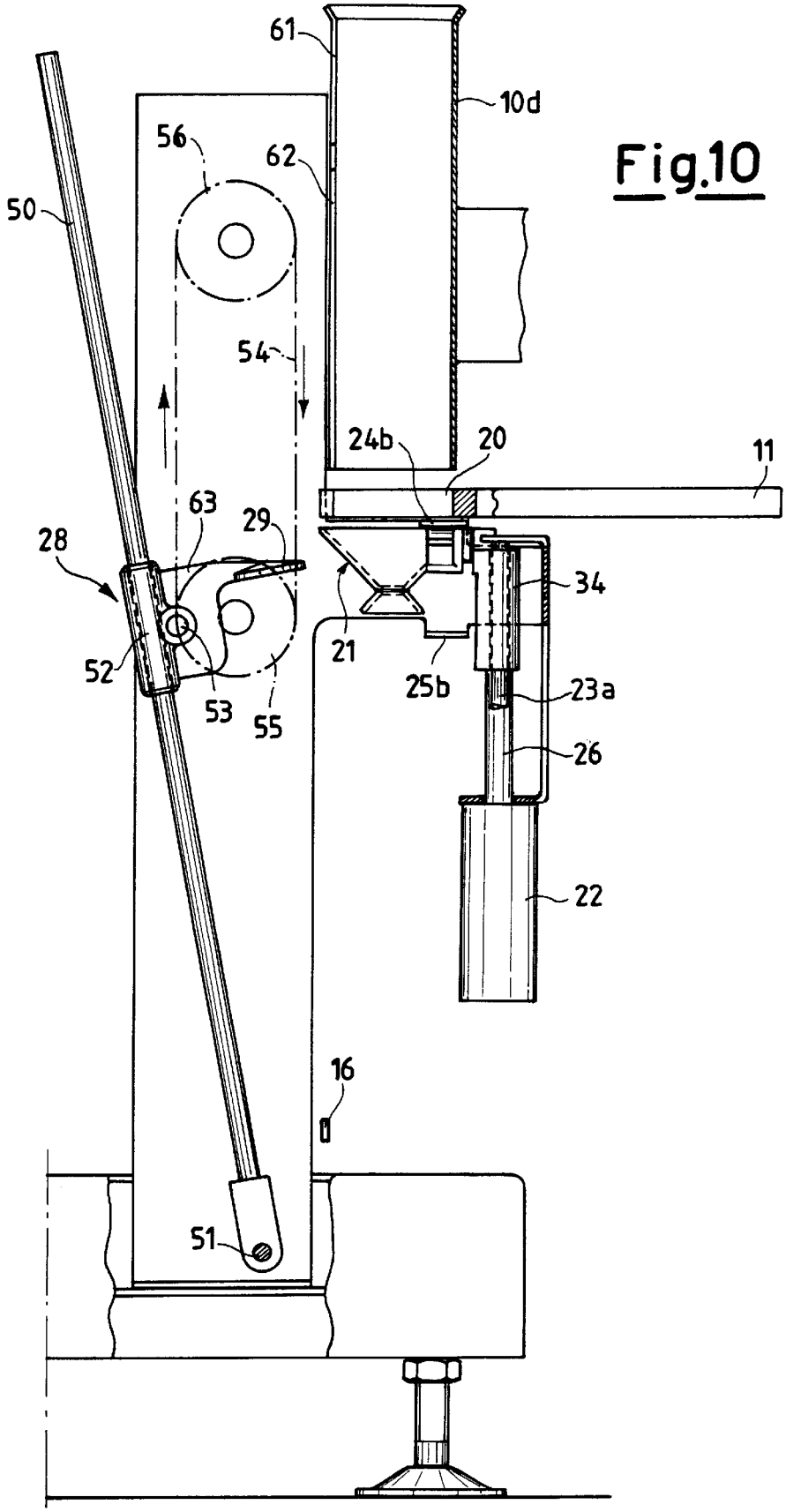

FIG. 9 is a partial side elevational view of the device for loading and centering of the spool on the plate support of the present invention, which shows the pivot of the slider at a position in which it travels around the toothed lower wheel so that the straight guide begins to retract and oscillate around the pin for the thruster or fitting end element to move rearwardly to allow the spool to travel the last fitting section in order for the thruster or fitting end element to move away from the spool; and FIG. 10 a partial side elevational view of the device for loading and centering of the spool on the plate support of the present invention, which shows the pivot of the slider having traveled around toothed lower wheel so as to take the straight guide into the furthest away position.

DETAILED DESCRIPTION OF THE PREFERRED EMBODIMENTS

Figure 1C:
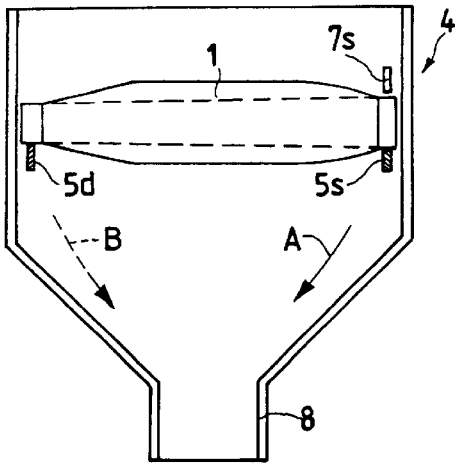
FIG. 1C is partial side top plan view of the device for loading and centering of the spool on the support plate of the present invention.
Figure 1D:
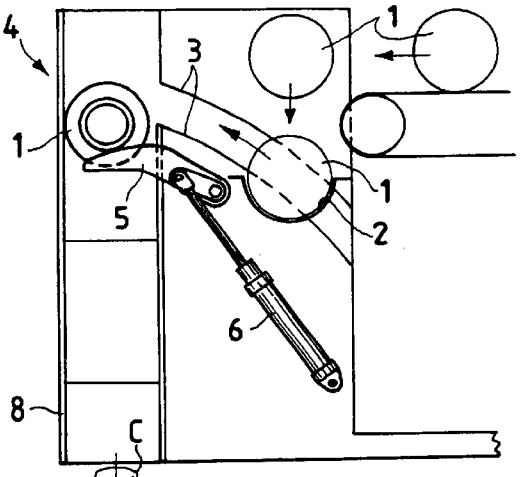
FIG. 1D is a side elevational view of the loading station shown in FIG. 1B.
Figure 1A:
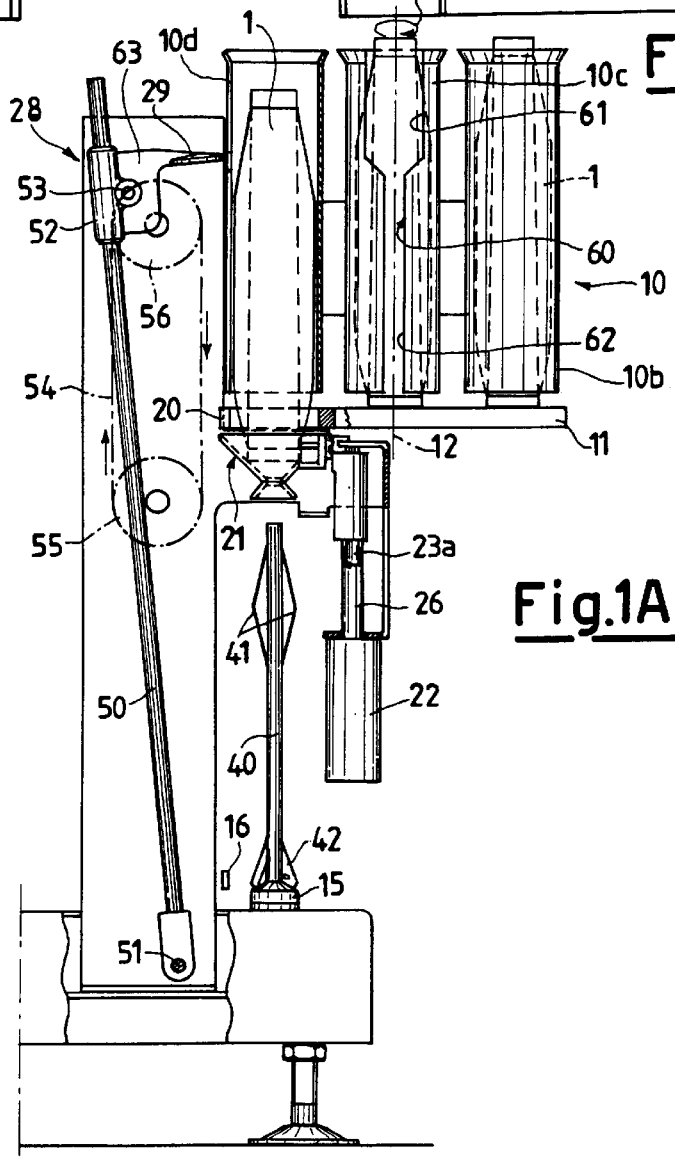
FIG. 1A is a partial side elevational view of the device for loading and centering of the spool on the support plate of the present invention.
Figure 1B:
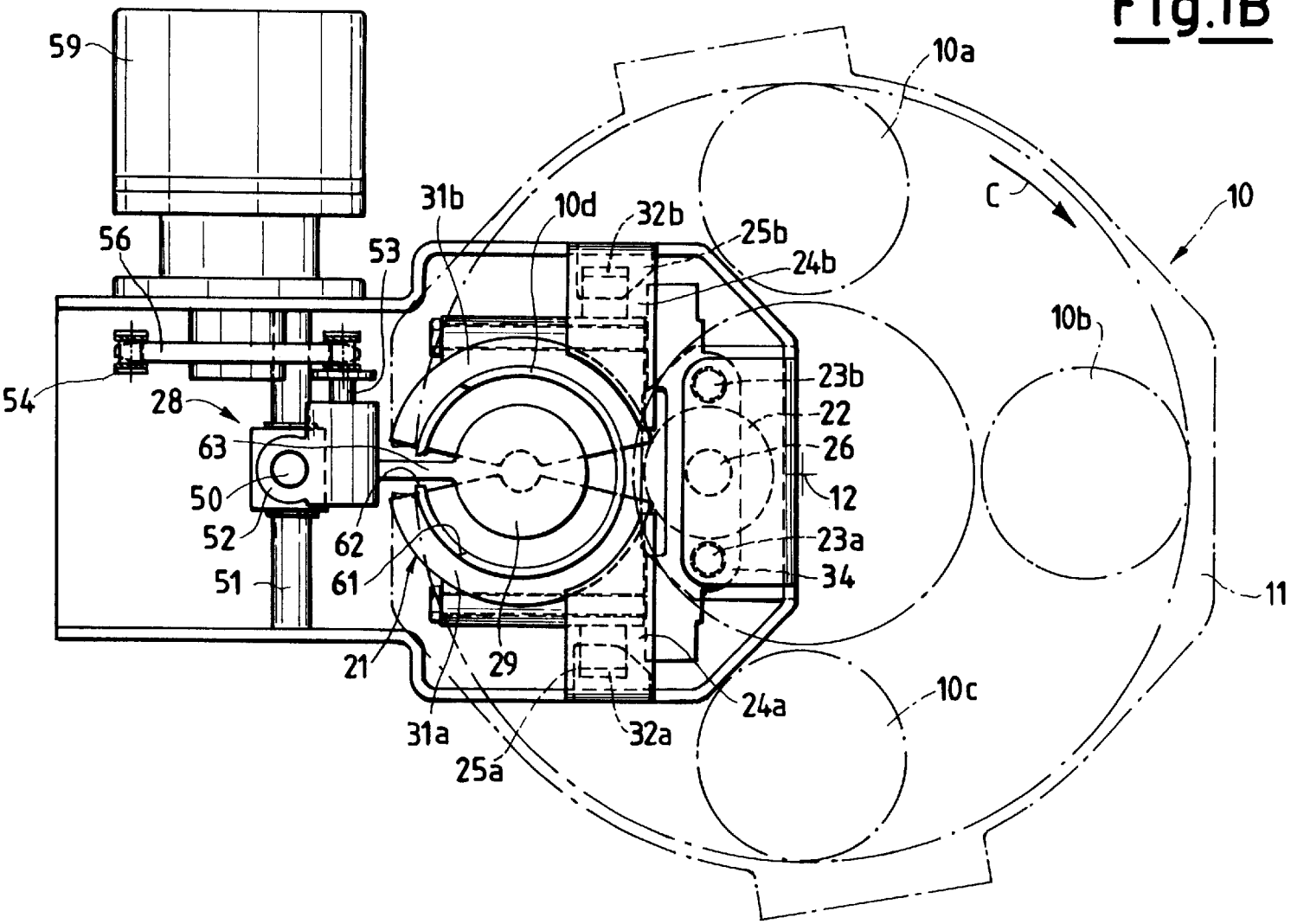
FIG. 1B is a front view of a loading station showing a spool to be loaded onto a support plate which works in conjunction with the device for loading and centering the spool on the support plate of the present invention.

FIGS. 1A,B,C, illustrate the device for loading and centering a spool on a support plate of the present invention in partial side elevational and partial top plan views, respectively.

FIGS. 1C and 1D show front and side elevational views, respectively, of a loading station, used in conjunction with the device for loading and centering the spool on the support plate of the present invention.

The spool 1 is conveyed to the device by known means, for example by a conveyor belt, and is deposited flatwise in a waiting tray 2, in a position which is random, as far as orientation of the spool is concerned. The spool is then transferred along the guides 3, by means of a thrust unit which is not shown in the figure, to the loading station 4. In this loading station 4, the spool 1 is supported on two retractable and extendable levers $\mathbf{5}_d$ $\mathbf{5}_s$, each of which is actuated by its own double effect piston 6. The ends of the conical tube of the spool 1 are supported on the said levers $\mathbf{5}_d$, $\mathbf{5}_s$, as shown in the detail in FIG. 1C.

The tube is probed by a sensor $\mathbf{7}_s$, in order to determine on which side the base with the larger diameter, which corresponds to the foot of the spool is disposed, and, on the other hand, to determine on which side the top of the spool, i.e. the end with the smaller diameter is disposed. The sensing system is of a known type, as described for example in Italian patent 1,237,924 in the name of the same applicant.

If, for example, the sensor $\mathbf{7}_s$, detects that the foot of the spool 1, in the detail shown from the front in FIG. 1C, is disposed on the right-hand side, the lever $\mathbf{5}_s$ is retracted, and the spool 1 is allowed to drop with its base facing downwards, according to the arrow A, which is shown as a solid line. In the opposite case, the lever $\mathbf{5}_d$ is retracted, and the spool 1 drops according to the arrow B, which is shown as a broken line. After the spool 1 has been released, the either lever $\mathbf{5}_s$ or lever $\mathbf{5}_d$, which has been actuated, is re-armed, in order to receive a new spool 1.

As the spool 1 drops, it is guided by a duct 8, which is in the shape of a funnel, and ends just above one of the cylindrical containers 10*a*–10*d* of the rotary device 10, which makes the spools 1 it contains rotate on a fixed platform 11, in order to make the spool 1 drop in an erect posture into the position cylindrical container 10*a*. The rotary device 10 is provided with drive means, which are not shown in the figure for the sake of simplicity and, which make it rotate clockwise in steps around its own axis 12, in the direction of arrow C.

In this rotation in steps, the rotary device 10 takes its spool-holder cylindrical containers 10*a*–10*d* into a plurality of positions, of waiting or work. In the embodiment which is shown in the figures, by way of example there are four of these cylindrical containers, from 10*a* to 10*d*. There can be a different number of cylindrical containers, depending on the number of positions of work and waiting, to be allocated to the rotary device 10. Again by way of example, the cylindrical container position 10*a* is the one in which the spool 1 to be fitted onto its support plate 15 is received; the cylindrical container position 10*b* is the one in which the spool 1 is removed from the so-called "secondary winder", in which the residual winding of coils of yarn around the base of the tube is removed, in order to be grasped and cut by known means; cylindrical container 10*c* is one of transit, without specific functions; and cylindrical container 10*d* is the one which is dedicated to support centering, release and raising of the spool 1 onto its support plate 15.

For each support plate 15 which is presented beneath the cylindrical aperture in cylindrical container 10*d*, the rotary device 10 rotates by one step, and takes a new spool 1 into the cylindrical container 10*d*. The arrival of the support plate 15 is detected by means of a sensor 16, for example a photocell, which supplies a signal to the control unit of the machine, which in turn issues the command for corresponding actuation of the rotary device 10, and for the loading operations. For the operations of loading the spool 1, the support plate 15 is locked in position, for example by means of a pneumatic piston, which is not shown in the figure.

In the platform 11, at the cylindrical container 10*d*, a circular aperture 20 is provided, which makes the spool drop into a device beneath, which is in the form of a funnel 21, in the shape of a cone, which can be opened. This funnel 21 can be moved vertically, between a highest position which is shown in FIG. 1A, and a lowered position, and it can be opened and closed, as illustrated in the following figures.

Figure 2:
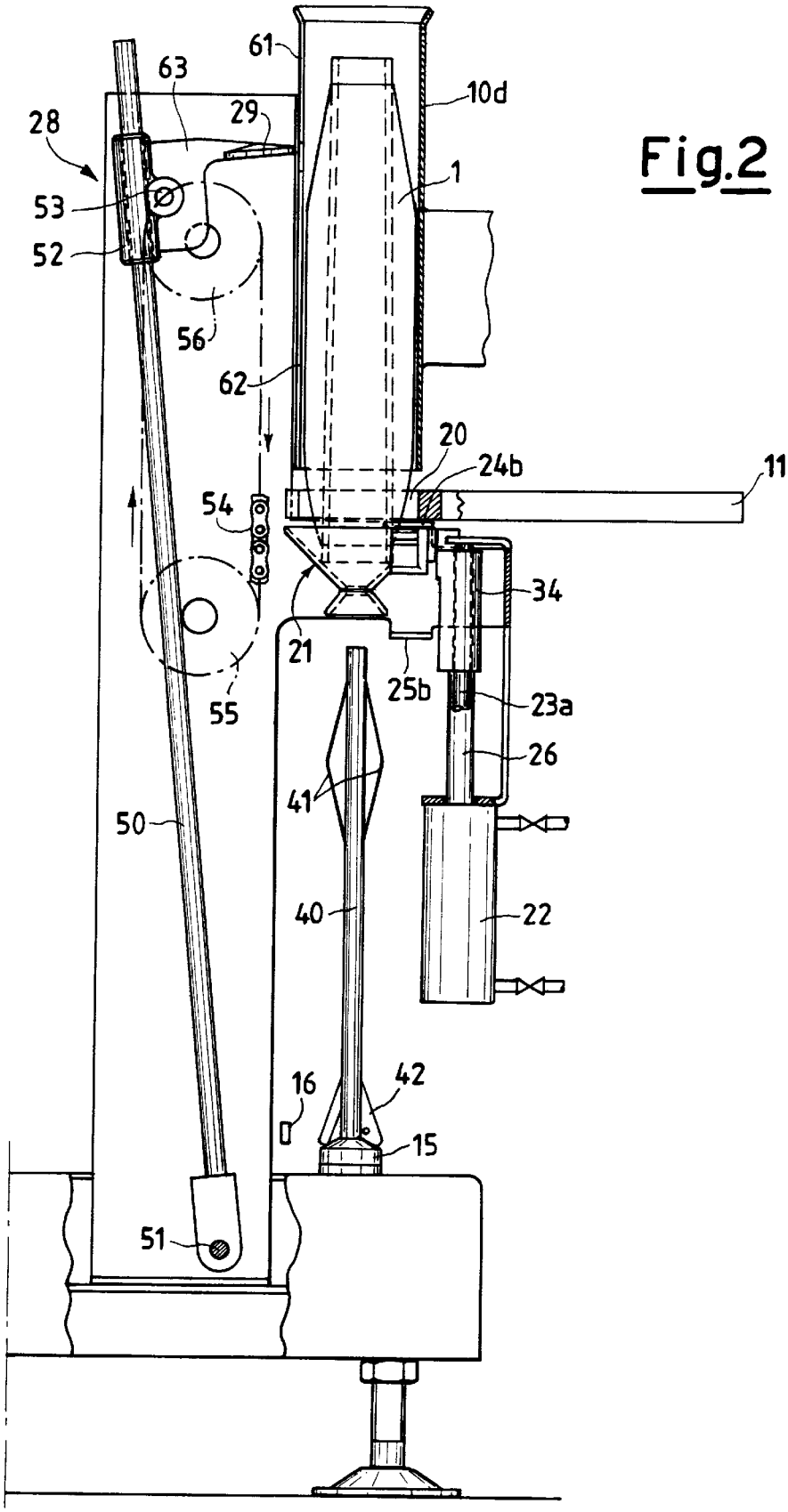
FIG. 2 is a partial side elevational view of the device for loading and centering of the spool on the plate support of the present invention showing the spool contained in one of the cylindrical containers.

FIG. 2 shows the spool 1 contained in its cylinder 10*d*, ready for the operation of centering and fitting on its support plate 15 for transport, which is disposed beneath the funnel 21. The funnel is moved by the double-effect pneumatic cylinder 22 along the vertical guides 23*a*, 23*b* between two upper and two lower end-of-travel stops 24*a*, 24*b* and 25*a*, 25*b* by means of a slider 26. With the centering action of the funnel 21, there is associated the action of a spool fitting device 28, which thrusts the spool onto the support plate 15, by means of a thruster or circular end element 29, to be supported on the top of the spool 1.

Figure 3:
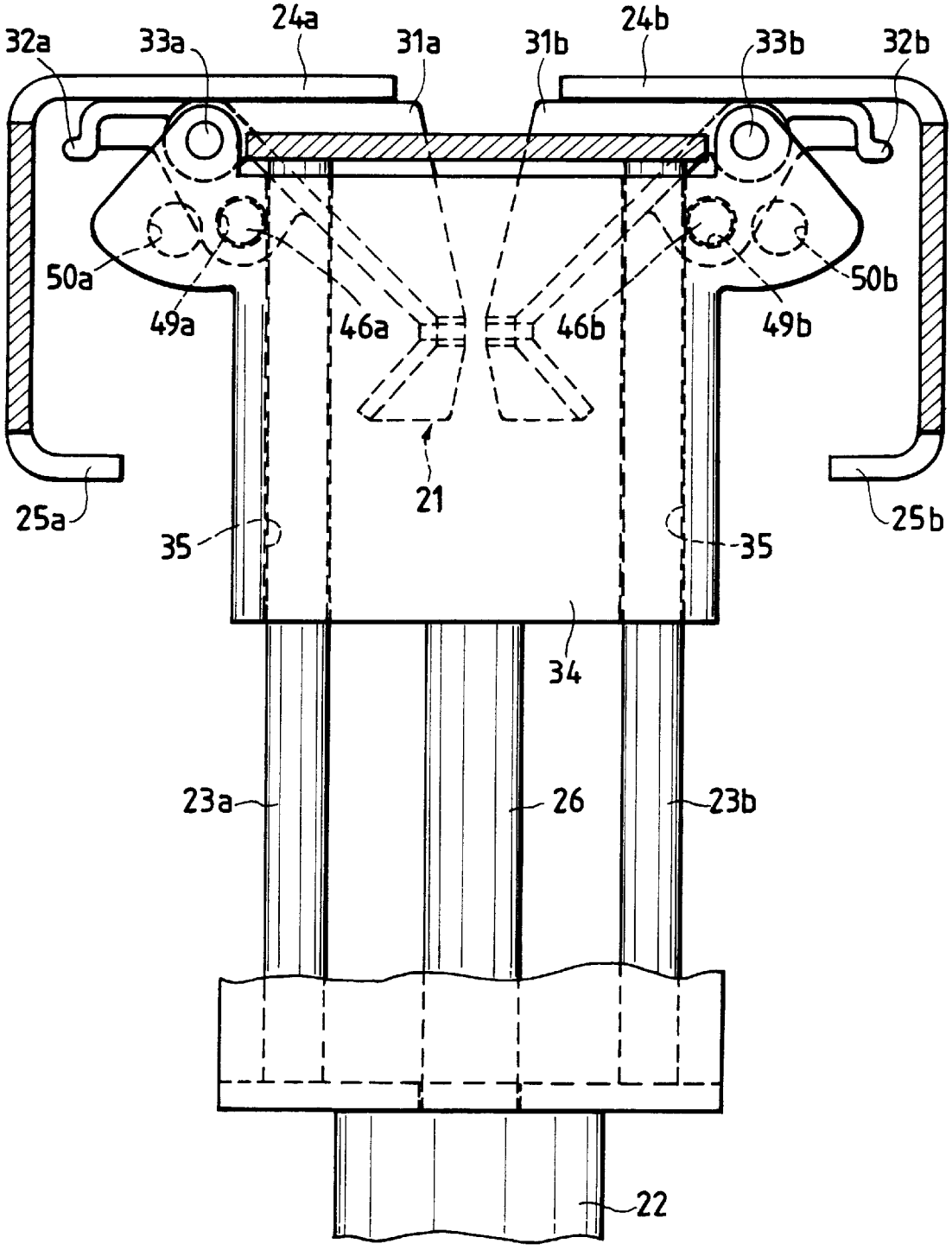
FIG. 3 is a side elevational view of the funnel of the device for loading and centering of the spool on the plate support of the present invention, wherein the funnel is shown in a closed position at the highest elevation.

FIGS. 3, 4, 5 and 6 illustrate the structure and the functioning of the funnel device 21. In FIG. 3, the funnel 21 is shown in its closed configuration, in the highest position. The funnel 21 is subdivided into two conical parts 31*a*, 31*b*, which have two opposite levers 32*a*, 32*b*, and are pivoted by means of the pins 33*a*, 33*b* onto a moving element 34, which is provided with hollow guides 35, 35 with a shape and transverse dimension which is compatible with that of the guides 23*a*, 23*b*,and is slid on the latter with vertical reciprocal motion, owing to the effect of the travel of the slider 26, which is actuated by the pneumatic cylinder 22. In FIG. 3, the levers 32*a*, 32*b*, are supported respectively against their upper end-of-travel stops 24*a*, 24*b*. The configuration in FIG. 3 corresponds to the state in FIG. 2, of the operation of loading the spool.

Figure 4:
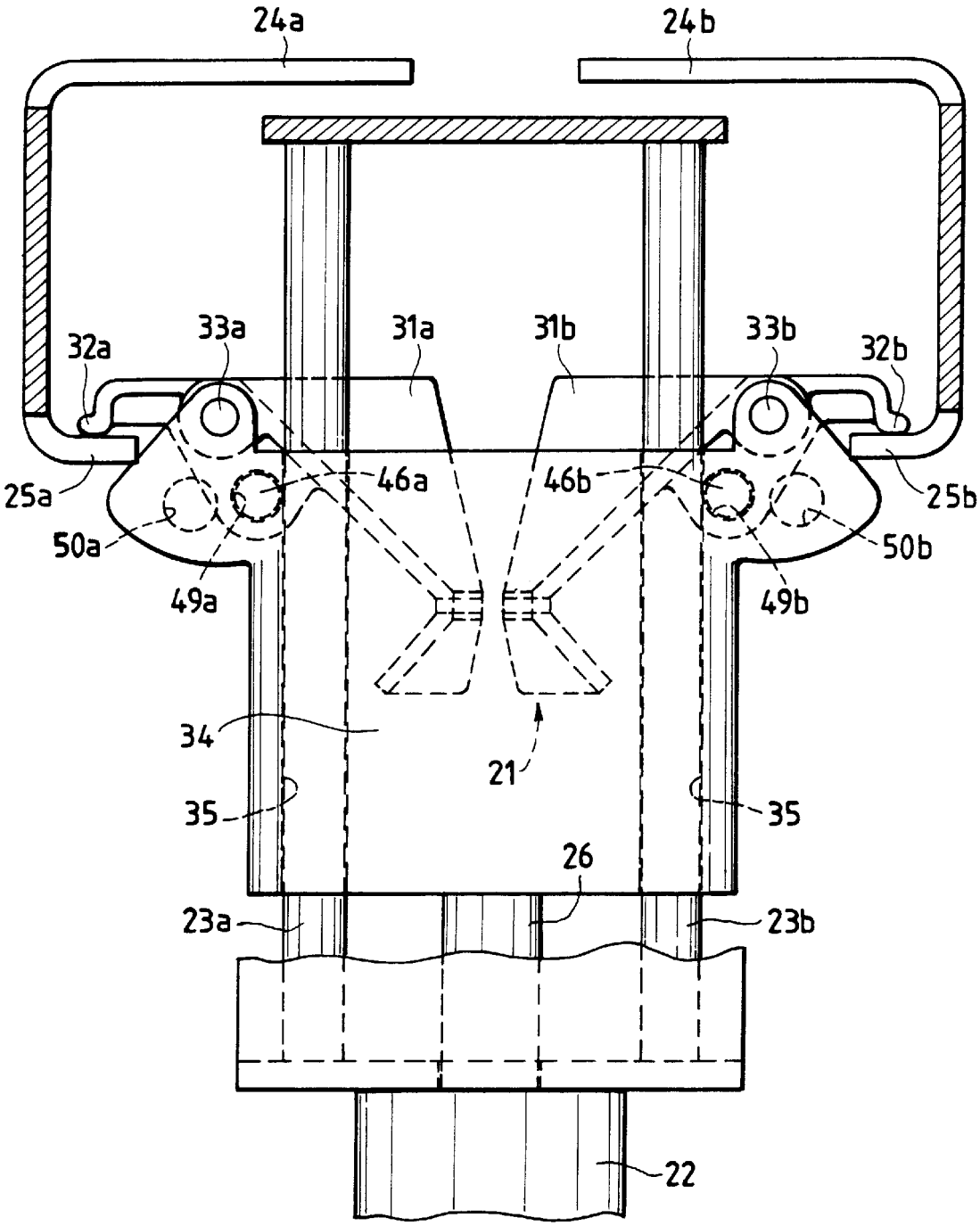
FIG. 4 is a side elevational view of the funnel of the device for loading and centering of the plate support of the present invention, wherein the funnel is shown in a closed position with a moving element lowered to an intermediate level until levers are supported on lower end-of-travel stops.
Figure 7:
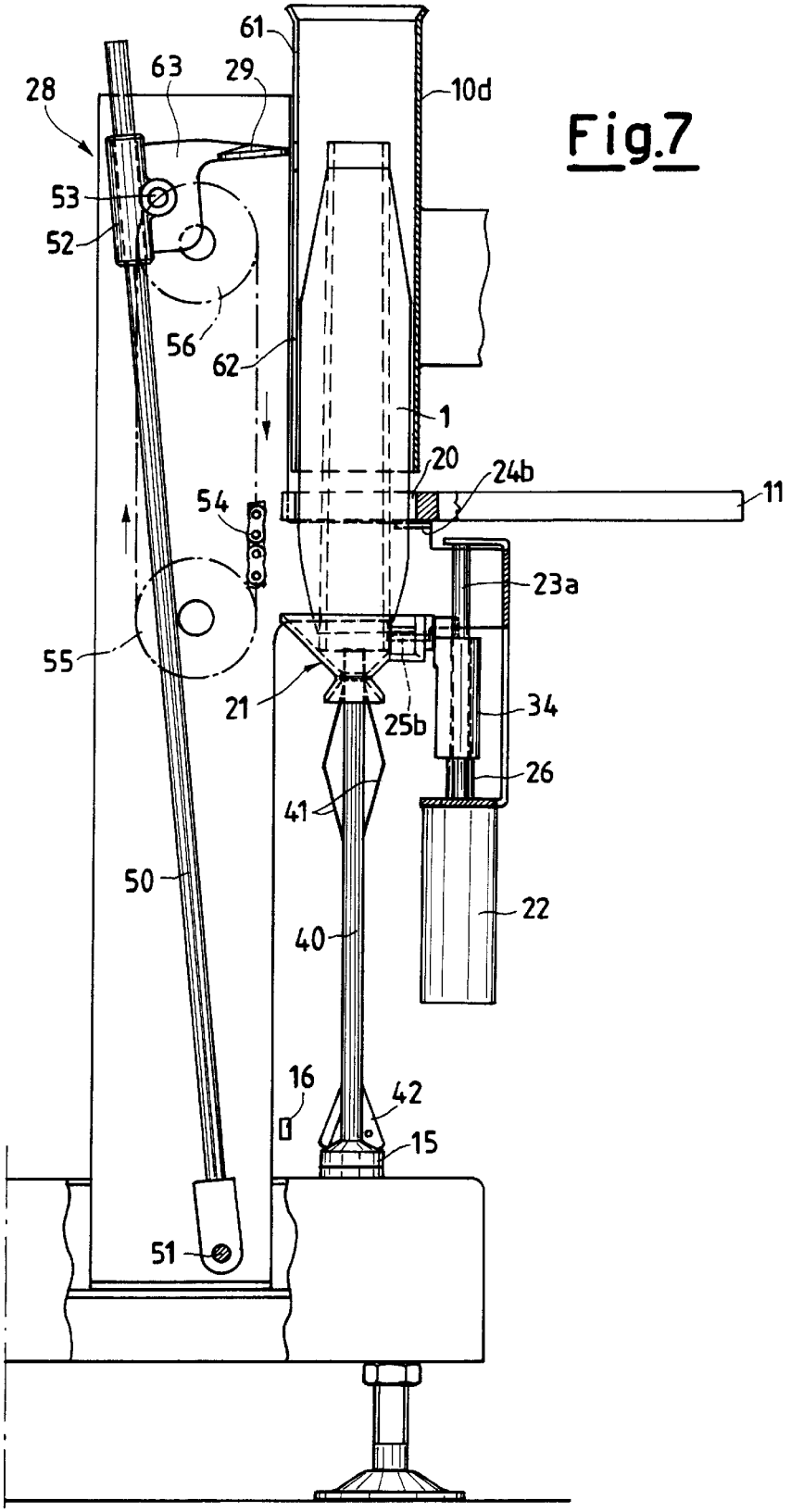
FIG. 7 is a partial side elevational view of the device for loading and centering of the spool on the plate support of the present invention, which shows the slider at the maximum elevation of the thruster or fitting end element via a straight guide which is still displaced relative to the spool.

In the configuration in FIG. 4, the moving element 34 is lowered to an intermediate level, again with the funnel 21 closed, until the levers 32*a*, 32*b* are supported on their lower end-of-travel stops 25*a*, 25*b*. The configuration in FIG. 4 corresponds to the step in FIG. 7, of the operation of loading the spool 1. The spool 1 has been lowered until it is centered, and the base of its tube is fitted onto the top of the supported plate 15. According to a preferred embodiment of the present invention, this operation is assisted by the end part of the funnel 21, which is in the shape of a funnel with a conicity contrary to that of the upper part of the funnel itself. In other words, the end part of the funnel 21 has a conicity with the vertex facing upwardly, whereas the body of the funnel 21 has a conicity with the vertex facing downwardly. In fact, this shape of the end part of the funnel 21 makes it possible to return the top of the rod of the support plate 15 to the correct position, if the support plate 15 is imperfectly positioned before being engaged with the spool 1.

In this position, the spool 1 cannot fail to pass its tube through the cavity, onto the rod 40 of the support plate 15 beneath.

Figure 5:
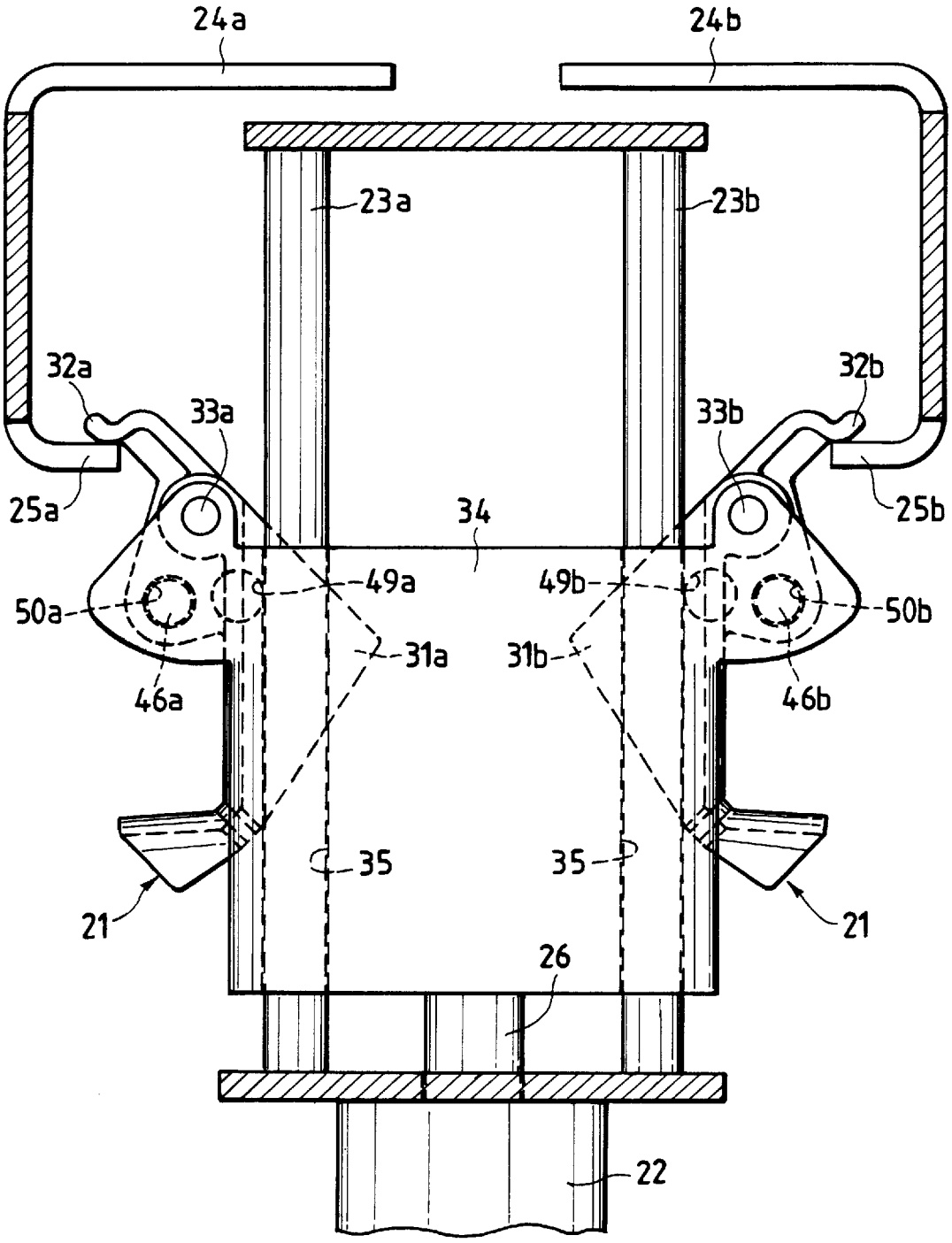
FIG. 5 is a side elevational view of the funnel of the device for loading and centering of the plate support of the present invention, wherein the funnel is shown in an open position with the moving element lowered to a lowest level due to further lowering of a slider and the levers, supported on end-of-travel stops, rotate semi-conical parts around pins in order to open the funnel.

In the configuration in FIG. 5, the moving element 34 is lowered to its lowest level, owing to the effect of further lowering of the slider 26. The levers 23*a*, 23*b*,which are supported on their end of travel stop 25*a*, 25*b*, rotate their semi-conical parts 31*a*, 31*b* around the corresponding pins 33*a*, 33*b*, in order to open the funnel 21 completely. The configuration in FIG. 5 corresponds to the step in FIG. 8, of the operation of loading the spool 1. The spool 1 drops inside the two open semi-conical parts 31*a*, 31*b* of the funnel 21, and its tube is inserted on the rod 40, until it is supported on the leaf springs 41, which project from the rod 40, and prevent the tube from descending further downwardly.

Figure 6:
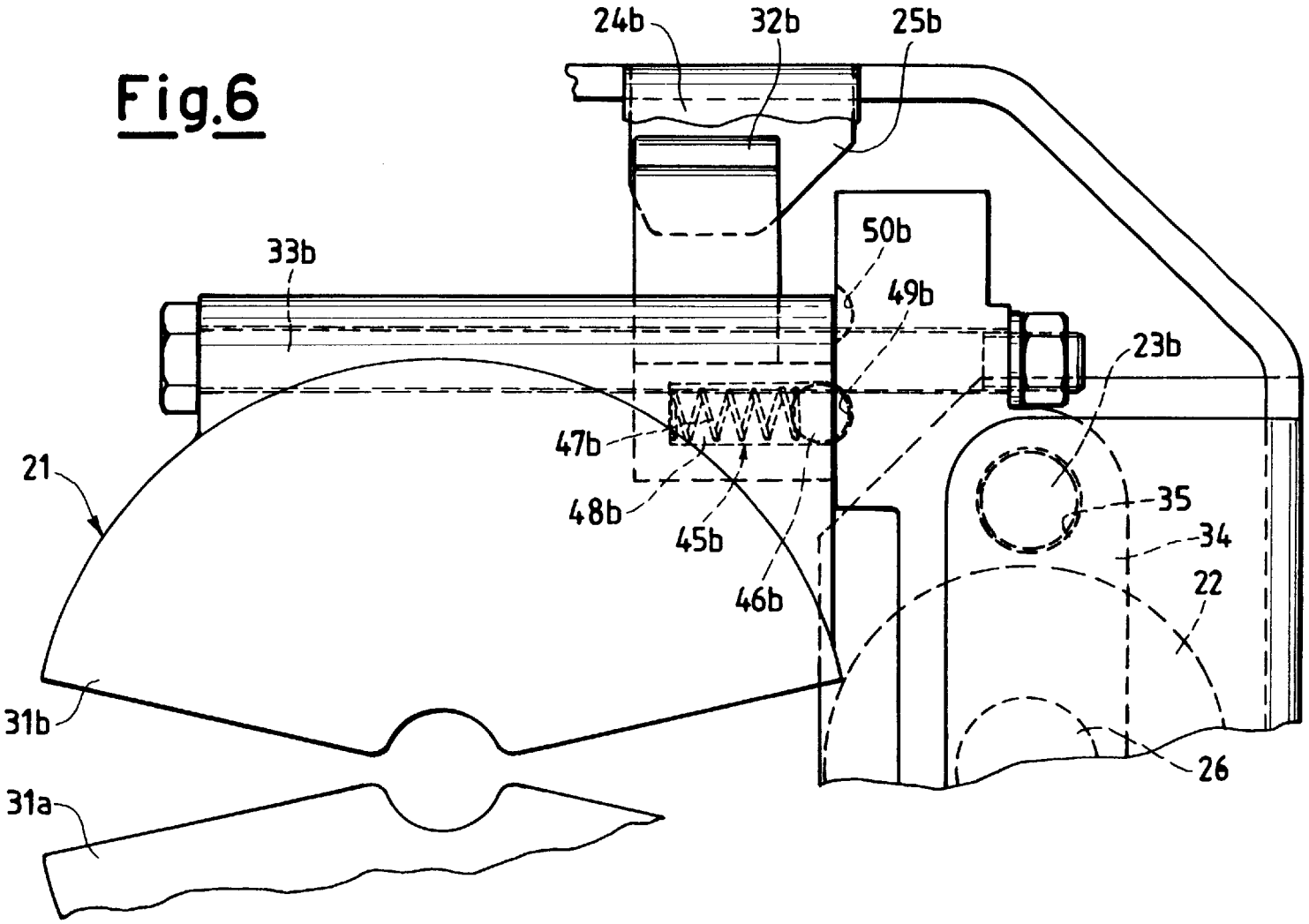
FIG. 6 is a partial plan view of the funnel of the device for loading and centering of the plate support of the present invention, wherein the funnel is shown in a closed position with a moving element lowered to an intermediate level until levers are supported on lower end-of-travel stops.

In FIG. 6, an improved embodiment of the device according to the present invention is illustrated. The two positions of opening and closure of the funnel 21 are kept fixed during the descending and rising travel of the moving element 34, by means of two spring blocks 45*a*, 45*b*, which are positioned such as to secure the two semi-conical parts 31*a*, 31*b* of the funnel 21 in the position of opening and closure, during the rising and descending travel. In FIG. 6, the spring block 45*b* is shown and, since the right-hand spring block, 45*a*, is specularly symmetrical relative there to. The spring blocks 45*a*, 45*b* each include balls 46*a*, 46*b*, respectively, which are thrust towards the exterior by springs 47*a*, 47*b* respectively which are accommodated in cavities 48*a*, 49*b*, respectively. The body of the moving element 34, has two pairs of cavities 49*a*, 49*b* and 50*a*, 50*b*, each of which have dimensions compatible with that of the balls 46*a*, 46*b*, and which correspond to the open and closed positions of the funnel 21. When the funnel 21 is closed, as shown in FIGS. 3 and 4, the balls 46*a*, 46*b* of the spring blocks 45*a*, 45*b* are at the cavities 49*a*, 49*b*. The springs 47*a*, 47*b* thrust the respective balls 46*a*, 46*b* towards the exterior, such that the balls 46*a*, 46*b* engage the cavities, and keep the funnel in the closed position. During the descending movement of the moving element 34, as far as the configuration in FIG. 4 is concerned, the funnel 21 is kept closed. When the moving element 34 continues to descend as far as the configuration in FIG. 5, it forces the balls 46*a*, 46*b* to return, thus compressing the springs 47*a*, 47*b*, and to move towards the exterior until the springs 47*a*, 47*b* reach the cavities 50*a*, 50*b*, in which the springs 47*a*, 47*b* once again thrust the respective balls 46*a*, 46*b* towards the exterior, until the balls 46*a*, 46*b* engage with the cavities 49*a*, 49*b* and keep the funnel 21 in the open position, until the rising path of the moving element 34 is completed, and until the configuration in FIG. 3 is obtained. On completion of the return path, the levers 32*a*, 32*b* are once again supported against their upper end-of-travel stops 24*a*, 24*b*, and rotate to close the two semi-conical parts 31*a*, 31*b*, in order to close the funnel 21. The spring blocks 45*a*, 45*b* return to the cavities 49*a*, 49*b*.

The operations of loading and fitting the spool take place according to the steps shown in FIGS. 2, 7, 8 and 9, by means of co-operation between the mobile funnel 21, and the fitting device 28, which thrusts the spool 1 onto the support plate 15.

The fitting device 28 can press with its thruster or fitting end element 29 on the upper end of the spool 1, in order to overcome the resistance of the centering springs 41, 41 which are disposed on rod 40 of the support plate 15, and to make the centering springs 41, 41 return their seat, such as to allow the tube of the spool to slide downwardly, until it is supported against the conical stop 42 at the base of the support plate 15, and is centered and locked.

Figure 8:
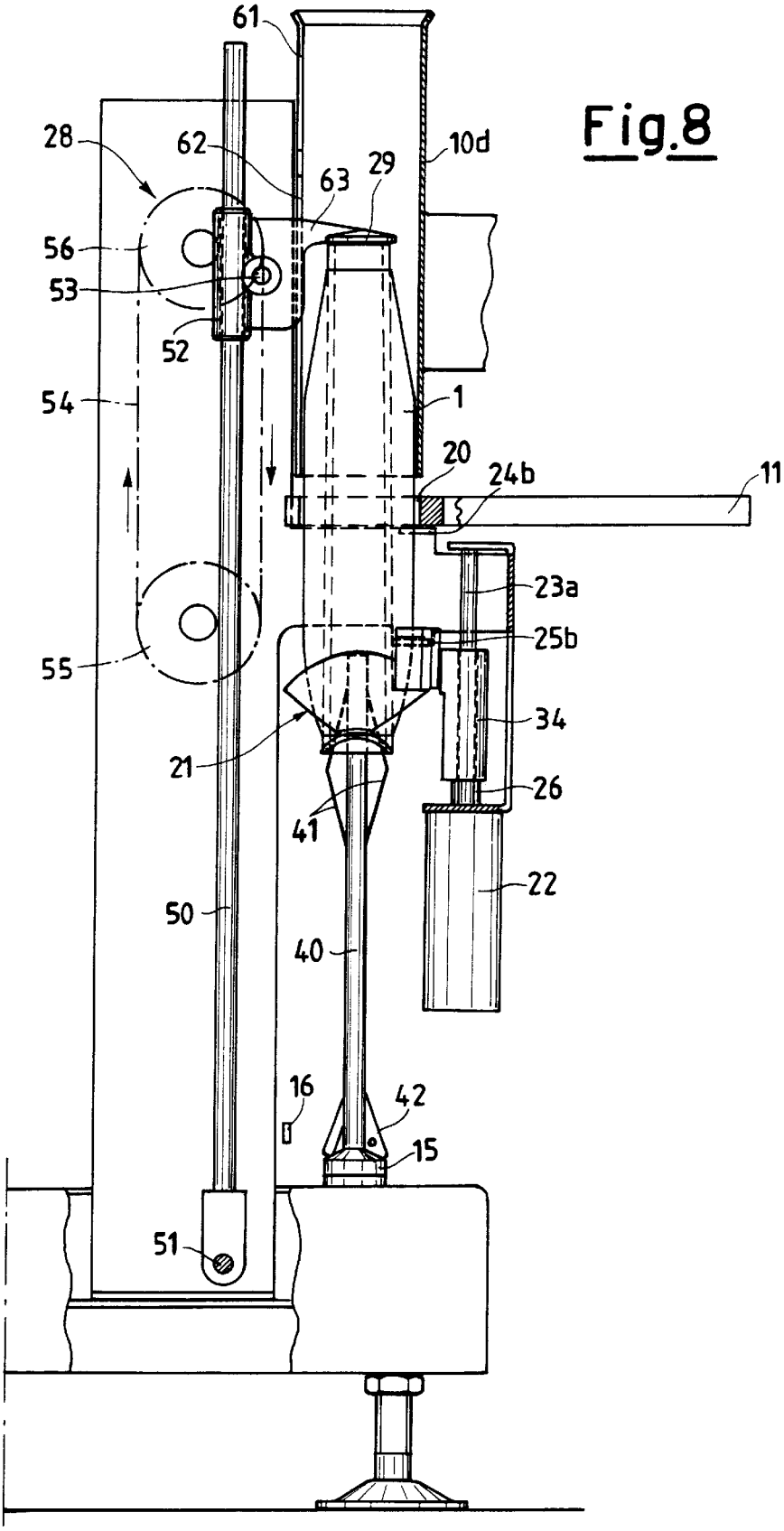
FIG. 8 is a partial side elevational view of the device for loading and centering of the spool on the plate support of the present invention, which shows the pivoting restraining device traveling around the toothed upper wheel and the thruster or fitting end element being elevated above the end of the spool.

This fitting device 28 comprises a straight guide 50, which is pivoted at a pin 51, and oscillates around the the pin 51. On the straight guide 50, a slider 52 slides and, said supports the said thruster or fitting end element 29. The motion of oscillation of the straight guide 50, and of reciprocal travel of the slider 52, is determined by a pivoting restraining device 53 of the slider 52, which, for example, consists of a pin which is secured to a link of a chain 54, which circulates around two toothed lower and upper wheels 55, and 56, one of which is provided with rotational drive by a motor 59. As illustrated in the configurations in FIGS. 2 and 7, the chain 54 moves in a clockwise direction, and positions the slider 52 at the maximum height of the thruster 29 or fitting end element, by means of the straight guide 50, which is still displaced relative to the spool 1. Whereas the pivoting restraining device 53 travels around the toothed upper wheel 56, the thruster or fitting element 29 is elevated above the end of the spool 1, as indicated in FIG. 8.

In order to permit passage of the thruster or fitting end element 29, the cylindrical containers 10*a–d* of the loading device 10 are provided with an aperture 60, at their point of tangency to the circumference of the lower platform 11, with a wider aperture 61 in the upper part, in order to allow the plate of the thruster or fitting end element 29 to penetrate inside the cylindrical containers 10*a–d*, and a narrower aperture 62, in order to permit passage of a rod 63 of the thruster or fitting end element 29. The aperture 62 is also provided in the fixed lower platform 11, in order to allow the rod 63 to pass through.

The straight guide 50 is now in a vertical position. The slider 52 begins its descent, the thruster or fitting end element 29 comes into contact with the top of the tube of the spool 1, and starts to press the spool 1 downwardly, when the two semi-conical parts 31*a*31*b* half-cones of the funnel 21 have opened, and the tube of the spool 1 has been fitted onto the rod 40 of the support plate 15, and has dropped until it is supported on its centered springs 41, 41.

After or during the descent of the thruster or fitting end element 29, the two semi-conical parts 31*a*, 31*b* of the funnel 21, in the configuration in which the funnel 21 is still open, are free to rise, and to close when the semi-conical parts 31*a*, 31*b* have finished rising, as already previously described, provided that the spool 1 has already been thrust downwardly onto the support plate 15, and is not blocking the trajectory of closure of the semi-conical parts 31*a*, 31*b*.

In the configuration in FIG. 9, the pivot 53 of the slider 52 has reached a position in which it travels around the, toothed lower wheel 55. The straight guide 50 begins to retract, and oscillates around the pin 51, the thruster or fitting end element 29 moves rearwardly, thus allowing the spool 1 to travel the last fitting section, and then moves away from the spool 1. The support plate 15, with the spool 1 loaded thereon can be moved away, and replaced by a new support plate 15, for loading of a new spool 1. The useful path of the thruster or fitting end element 29 corresponds to the length of travel required for the action of fitting the tube of the spool 1, whilst overcoming the opposition of the springs 41, 41; this path depends both on the geometry of the tube of the spool 1, and on the shape of the rod of the support plate 15, with its springs 41, 41. The path of the thruster or fitting end element 29 can easily be regulated by adjusting the distance between the toothed upper and lower wheels 55, and 56, as well as the length of the chain 54.

In the configuration in FIG. 10, the pivot 53 of the slider 52 has travelled around the, toothed lower wheel 55, and has taken the straight guide 50 into the position in which it is furthest away. As the slider 52 rises to the position shown in FIG. 2, a new support plate 15 arrives. As a result of the arrival of the support plate 15, a step by the loader 10 takes a new spool 1 into cylindrical container 10*d*, in which the funnel 21 is already in the raised position, and is closed in order to receive the spool 1. The loading cycle can then be repeated for the said new spool 1.

The operations described, which are carried out by the movement actuators of the funnels 21, the initial presenters, the rotary distributor 10 and the fitting device 28, are controlled and coordinated by the control unit of the machine, in order to guarantee the necessary synchronism between the various component devices, and in order to prevent interference and collision between the parts, or any damage to the yarn of the spools. The start and end of each step of the method for loading the spool is controlled, in order to give the go-ahead for implementation of the successive step, and to verify the duration of the latter.

The device and the method for loading the spools onto their support plates with associated springs makes it possible to carry out supply to a spooler in short periods of time, whilst securing the spools firmly and efficiently to their support plate, without involving any constraints in the speeds of winding, or in the accessory preparation operations.

The device can also easily be adapted to spools and tubes of the entire range of tubes which are used in the operations of preparation and finishing of the yarn. Differences of shape of the spool support plate can also easily be overcome, by means of the same regulations and adjustments.

What is claimed is:

1. A spool loading and centering device for loading and centering spools on support plates in order for each spool of the spools to be sent to an automatic winding device for having yarn wound therearound, wherein each support plate of the support plates is provided with a rod and centering and restraining springs, said spool loading and centering device comprising:

a spool presentation and centering device for presentation and centering of each spool of the spools onto each support plate of the support plates;

a spool fitting device for fitting a tube each spool of the spools onto a top of the rod each support plate of said support plates, wherein said spool fitting device includes a slider having means for actuation of vertical travel with reciprocal motion and having a fitting end thrust element for following a useful path corresponding to fitting of the tube of each spool of said spools, until each spool of said spools is supported against a conical base stop of each support plate of said support plates.

2. The spool loading and centering device according to claim 1, wherein said spool presentation and centering device includes a funnel having lower and upper parts, said lower part having a conicity contrary to a conicity of said upper part of said funnel.

3. The spool loading and centering device according to claim 1, wherein said spool presentation and centering device includes a funnel, said funnel having open and closed positions and semi-conical elements, said semi-conical elements of said funnel being movable in a vertical direction.

4. The spool loading and centering device according to claim 3, wherein said funnel includes locking units for securing said semi-conical elements in both said open and closed positions, during rising and descending travel of said device for loading and centering of said spools on said support plates.

5. The spool loading and centering device according to claim 3, wherein said funnel includes levers for performing vertical reciprocal motions, and for opening and closing said semi-conical elements, when said semi-conical elements meet lower and upper end-of-travel stops, respectively.

6. The spool loading and centering device according to claim 1, wherein said spool fitting device includes a straight guide, said straight guide having a slider sliding thereon, said slider supporting said fitting end thrust element, said slider including a pivoting restraining device secured to a chain, said pivoting restraining device determining an oscillating motion of said straight guide and a reciprocal travel motion of said slider, and said chain circulating around two toothed wheels, said two toothed wheels being provided with rotational drive means.

7. The spool loading and centering device according to claim 6, wherein said spool fitting device includes means for regulation of the path followed by the fitting end thrust element, said fitting end thrust element including means for adjustment of a distance between said two toothed wheels.

8. A method for loading and centering spools on support plates, the support plates being provided with a rod and centering and restraining springs, and the spools to be sent for winding of yarn therearound to an automatic spooler, said method for loading and centering comprising the steps of:

presenting and centering each spool of the spools onto a top of the rod of the support plate;

releasing each spool of the spools presented, until each spool of the spools is supported on springs of each support plate of said support plates; and fitting each spool, of the spools, with a useful path which extends until each spool, of the spools, is supported against a base stop of each support plate of the support plates.

* * * * *